US010538895B2

(12) United States Patent
Heath

(10) Patent No.: US 10,538,895 B2
(45) Date of Patent: Jan. 21, 2020

(54) IMPLEMENT ATTACHMENT DEVICE

(71) Applicant: Daniel Heath, Waco, TX (US)

(72) Inventor: Daniel Heath, Waco, TX (US)

( * ) Notice: Subject to any disclaimer, the term of this patent is extended or adjusted under 35 U.S.C. 154(b) by 0 days.

(21) Appl. No.: 15/627,767

(22) Filed: Jun. 20, 2017

(65) Prior Publication Data

US 2017/0362794 A1 Dec. 21, 2017

Related U.S. Application Data

(60) Provisional application No. 62/493,079, filed on Jun. 21, 2016.

(51) Int. Cl.

| | |
|---|---|
| ***E02F 3/36*** | (2006.01) |
| ***E02F 3/84*** | (2006.01) |
| ***E02F 3/96*** | (2006.01) |
| ***B66F 9/12*** | (2006.01) |
| *E02F 3/76* | (2006.01) |

(52) U.S. Cl.

CPC ..... *E02F 3/3663* (2013.01); *B66F 9/12* (2013.01); *E02F 3/3645* (2013.01); *E02F 3/844* (2013.01); *E02F 3/962* (2013.01); *E02F 3/3654* (2013.01); *E02F 3/7663* (2013.01)

(58) Field of Classification Search

CPC ..... E02F 3/3663; E02F 3/3645; E02F 3/844; E02F 3/962; E02F 3/3654; E02F 3/7663; B66F 9/12

See application file for complete search history.

(56) References Cited

U.S. PATENT DOCUMENTS

| | | | | |
|---|---|---|---|---|
| 1,716,432 A * | 6/1929 | Downie | E02F 9/2808 | 37/403 |
| 2,262,415 A * | 11/1941 | Williams | E02F 3/8155 | 172/777 |
| 2,632,261 A * | 3/1953 | Ferris, Jr. | E02F 3/8152 | 172/777 |
| 2,979,215 A * | 4/1961 | Brisson | E02F 3/342 | 37/264 |
| 3,034,237 A * | 5/1962 | Wolfe | E02F 3/769 | 37/241 |
| 3,362,554 A * | 1/1968 | Fortier | A01C 3/04 | 37/405 |

(Continued)

FOREIGN PATENT DOCUMENTS

| | | |
|---|---|---|
| CN | 2771306 Y | 12/2006 |
| DE | 202010003567 U1 | 8/2010 |

(Continued)

OTHER PUBLICATIONS

W. S. Hockey, Tractor Mounted Implements and Adaptations, Proceedings of the Institution of Mechanical Engineers: Automobile Division, vol. 15, Issue 1 1961.

*Primary Examiner* — Jamie L McGowan
(74) *Attorney, Agent, or Firm* — John A. Powell

(57) ABSTRACT

An implement attachment device for tractors allowing for easy and quick attachment of implements and tools to a tractor bucket along with correspondingly easy and quick detachment of such implements and tools, wherein such device may itself may be readily connected or disconnected to the bucket and while connected may be easily switched from a bottom use-ready position to a top stowed position in relation to the tractor bucket.

15 Claims, 7 Drawing Sheets

(56) References Cited

U.S. PATENT DOCUMENTS 3,478,449 A * 11/1969 Baker ..... E02F 3/401 172/719
3,938,680 A * 2/1976 Grimes ..... E02F 3/401 37/409
3,975,844 A * 8/1976 Olson ..... E02F 3/404 37/405
4,023,287 A * 5/1977 de Brito ..... E01H 5/04 37/231
4,042,141 A * 8/1977 Schweigert ..... E02F 3/3417 414/703
4,125,952 A 11/1978 Jennings
4,151,664 A 1/1979 Maura
4,241,525 A * 12/1980 Mann ..... E02F 3/7609 172/748
4,372,063 A * 2/1983 Work ..... A01G 23/093 37/301
4,550,512 A 5/1985 Felstet
4,566,844 A * 1/1986 Campin ..... E02F 3/404 37/409
4,718,816 A * 1/1988 King ..... B66C 1/447 414/23
5,064,338 A * 11/1991 Lawrence ..... A01B 59/06 180/53.7
5,129,169 A 7/1992 Aubichon
5,149,122 A * 9/1992 Helber ..... B60D 1/42 280/491.1
5,410,824 A * 5/1995 Pedersen ..... E01H 5/04 37/214
5,450,910 A * 9/1995 Strzyzewski ..... A01B 45/02 172/21
5,664,348 A 9/1997 Omann
5,797,461 A * 8/1998 Noble ..... E02F 3/404 172/200
5,957,650 A * 9/1999 Rollo ..... E02F 3/404 37/406
6,098,321 A * 8/2000 Logan ..... E02F 3/401 37/403
6,119,377 A * 9/2000 Rubio ..... E02F 3/96 37/403
6,718,662 B1 * 4/2004 Schaff ..... E02F 3/8152 171/43
6,817,121 B2 11/2004 Grgic
6,848,142 B2 2/2005 Truan et al.
6,988,866 B2 1/2006 Friedland
7,429,159 B2 9/2008 Priest
7,673,403 B2 * 3/2010 Bridges ..... E02F 3/962 37/403
7,641,436 B2 5/2010 Wippel
7,818,903 B2 * 10/2010 Elliot ..... A01B 59/064 172/445.1
7,913,431 B1 * 3/2011 Beam ..... A01G 23/06 37/406
7,975,776 B2 * 7/2011 Chimento ..... A01B 59/002 172/272
8,381,421 B2 * 2/2013 Lhota ..... A01B 59/00 280/296
8,381,422 B2 * 2/2013 Hill ..... E02F 3/7627 172/817
9,506,215 B2 * 11/2016 Krell ..... E02F 3/404
2004/0253089 A1 * 12/2004 Atencio ..... A01D 87/0076 414/724
2012/0198734 A1 * 8/2012 Murray ..... A01B 59/04 37/403
2014/0338935 A1 * 11/2014 Kimball ..... A01B 61/046 172/1
2015/0176241 A1 * 6/2015 Krell ..... E02F 3/404 37/444
2017/0362794 A1 * 12/2017 Heath ..... E02F 3/3663

FOREIGN PATENT DOCUMENTS

FR 3006342 A1 5/2014
GB 643506 A 9/1950
GB 2069971 A 3/1981

* cited by examiner

IMPLEMENT ATTACHMENT DEVICE

PRIORITY CLAIMS

This application claims priority to U.S. Provisional Application No. 62/493,079, filed on Jun. 21, 2016, which is hereby incorporated by reference.

TECHNICAL FIELD OF THE INVENTION

The present invention is generally directed to devices that permit the attachment of implements or tools to the bucket or front-end loader of a tractor or other mobile unit.

BACKGROUND ART OF THE INVENTION

Tractors and other mobile units (jointly referred to herein as "tractors") with buckets, front-end loaders, or back-end loaders (all of which are jointly referred to herein as "buckets") are used for handling and moving many types of particulate material. Such buckets are normally supported by one or more arms of the tractor, where the arms are hydraulically actuated up and down using a motor and the bucket is moved forward or backward with the movement of the tractor. The buckets are normally used to scrape or scoop up particulate material and move that material from one location to another. For instance, buckets attached to tractors are frequently used for scooping and moving earth, sand, gravel, rocks, snow, and many other types of particulate material.

While such buckets are well-suited for handling and moving particulate materials, they are less satisfactory for handling other types of materials and for performing other types of work that frequently becomes necessary in rural or construction settings. For instance, moving piles of brush, picking up pallets on which materials are stacked, moving rubbish and trash piles, hauling large hay bales, clearing vines or smoothing a road surface are tasks that are not easily accomplished by use of a standard tractor bucket. As a result, the need frequently arises to remove the bucket from the tractor and exchange it for a separate implement (the terms "implement" and "tool" are treated as interchangeable) that can be directly mounted to the arms of the tractor for use in performing a particular task or type of work. Making such a changeover from a bucket to a separate implement that is directly mounted onto a tractor is cumbersome, inefficient and requires the substantial expenditure of time and effort to remove the bucket and then remount the implement on the arms of the tractor. It is preferable to avoid this type of inefficiency, if possible.

Several attempts have been made in the past to provide for an implement adapter device that will permit the attachment of a separate implement to the bucket of a tractor. Such implement adapter devices have taken the form of a device that has a frontal portion located in the front of the bucket on which the workload or workpiece is supported during the handling process. These devices are supported by the leading edge of the bottom wall of a bucket where the main structure of the implement adapter device overlies the leading edge of the bottom wall of the bucket and the device has a slot or groove into which the leading edge of the bottom wall of the bucket is received. The working load supported by the front end portion of these implement adapter devices is typically counter-balanced by a rear portion that underlies and bears against the bottom wall of the bucket so that the support for the implement adapter device and the supported workload is designed on cantilever principles. In several instances these types of implement adapter devices use clamping means in which the leading edge of the bucket is maintained in the slot or groove of the device with removable clamping means that clamp the device onto one or more edges of the bucket. These types of clamping devices often loosen during use and permit the implement adapter device to separate from the walls of the bucket.

In other instances, mechanical fasteners that rigidly affix implements directly to one or more walls of a bucket or loader have been advocated. These methods require substantial time and effort to manually rigidly affix an implement to a bucket because they require mechanical interconnection of the implement directly with the bucket. Further, such methods require additional time and effort to mechanically disconnect the implement from the bucket when the implement is no longer in use and the user wishes to return to using the bucket by itself. Such changeovers waste time and effort during the initial rigid affixation of the implement directly to the bucket and during the subsequent mechanical removal of implement from the bucket.

Another method which has been suggested for securing implements to a bucket is to use chains, ropes, or similar flexible attachment means to fasten implements or implement adapters to one or more bucket walls. This approach may also entail the use of an overcenter arm, a buckle, pulley or similar device for adjusting the overall length of the fastener. However, it is often difficult to maintain a tight connection that prevents movement of the implement or implement adapter in this arrangement, which means that movement of the implements relative to the bucket is possible and therefore use of the implements becomes problematic.

In an effort to address the problems exhibited by the aforementioned types of implement adapter devices and methods, a number of somewhat more sophisticated implement adapter mechanisms have been proposed. For instance, U.S. Pat. No. 4,550,512 to Felstet discloses an implement adapter system involving a bucket with built-in sockets for receiving an implement, where the sockets are part of the side walls and bottom wall of the bucket itself. Felstet's mechanism involves the insertion of part of an implement directly into the sockets that are disposed within the body of the bucket and then rigid affixation of the implement to the bucket using bolts that are inserted through the bucket's sockets and through the implement. Likewise, U.S. Pat. No. 6,088,938 to Logan discloses an implement adapter device comprised of a plate for attaching implements that is rigidly connected to an excavator by at least four arms. A pair of said arms are coupled with the wrist pin of the excavator, and a second pair of said arms are rigidly fastened to the inside portion of the side walls of the excavator. The patent to Logan also discloses a hinged attachment device for connecting tools or implements to an excavator. The attachment device is connected to a plate with multiple hinges that engage the excavator. The attachment device pivots about the hinges and pins are used to secure the base of the attachment to the excavator.

U.S. Pat. No. 6,848,142 to Truan discloses a bucket-mounted sweeper implement and a proposed apparatus for attaching such an implement to a bucket. The Truan patent discloses an implement that is permanently, rigidly affixed to a housing wherein the housing has a pair of top mounting brackets on both sides of the housing that are each provided with multiple attachment points. When it is desired to place the implement into use, the implement and its housing and mounting brackets may be bolted to two mounting arms that are themselves pinned to the inside portions of the side walls of a bucket. The apparatus appears to be primarily designed for use with a brush-type implement with a housing that can be connected on each of its ends to the mounting arms at the location of the mounting brackets and will then hang down from the bucket and can be moved along a surface for sweeping particulate materials. The apparatus is problematic during actual use because removal of a specific implement requites that the implement and its mounting brackets must be unbolted from each of the mounting arms. Alternatively, an implement can be removed by unpinning the mounting arms from the sidewalls of the bucket while the implement is still bolted to the mounting arms, but this does not allow for immediate attachment of a different implement to the bucket because such a changeover to another implement would still require the unbolting of the implement from the mounting arms. Thus, a changeover between implements is cumbersome and inefficient. It is also unclear how much support is provided to various implements by the feet of the mounting arms that engage with the bottom wall of the bucket, and it is possible that heavier implements may not be well supported by the apparatus, whereas the brush implement disclosed by Truan apparently receives at least some physical support from the ground or surface underlying the brush implement's bristles.

SUMMARY

An implement attachment device for the attachment of various implements to a tractor bucket is disclosed. Problems and limitations in the prior art are overcome by the disclosed implement attachment device that permits rapid attachment or detachment of implements to a tractor bucket using one or more receivers that are provided by a main receiver bar. The implements are removably pinned in place to the main receiver bar by pins that pass through holes provided in the shank of the implements and through holes provided in the receivers of the main receiver bar. Additionally, the implement attachment device may be pivoted and reversibly locked into either an upright, stowed position for standard use of the tractor bucket, or may be pivoted and locked into a lower, use-ready position for the use of one or more attached implements that are connected to the main receiver bar.

The implement attachment device includes a main receiver bar that is connected to two swing arms. The two swing arms are each connected to a sidewall of the tractor bucket with both a pivot pin and a positioning pin. The positioning pin may be inserted in either a top position hole when the implement attachment device is in the upright, stowed position, or in a bottom position hole when the implement attachment device is in the lower, use-ready position. In order to switch from the stowed position to the use-ready position, the positioning pin is removed from the top position hole, the swing arms and attached main receiver bar are rotated downward away from the top edge of the bucket and toward the bottom edge of the bucket, and then the swing arms are each re-pinned using the positioning pins by inserting the positioning pins through the bottom position holes. This process will move the implement attachment device to the lower, use-ready position. It should be appreciated that this process may be reversed in order to move the implement attachment device, and any attached implements attached thereto, back to the stowed position near the top of the tractor bucket.

The implement attachment device is also adjustable in relation to the width of the tractor bucket to which it is intended to be attached and used. At the location of the connections between the two swing arms and the main receiver bar, the swing arms are of a smaller diameter and will slidably fit into open ends of the main receiver bar and may be slid to and fro within the body of the main receiver bar until the time of final assembly, at which point the two swing arms are rigidly affixed to the main receiver bar using rigid affixation means. Thus, the implement attachment device can be adjusted to fit the width of most tractor buckets during assembly of the device onto the tractor bucket.

The implement attachment device hereby disclosed overcomes a number of limitations with the prior art because it allows for rapid changeover between different types of implements and because it also allows for implements to remain attached to the bucket of a tractor yet they can be moved into a stowed position in which the tractor's bucket may be used in standard fashion for an interim time between consecutive uses of the attached implements.

BRIEF DESCRIPTION OF THE DRAWINGS

The disclosed implement attachment device will be described with reference to the accompanying drawings, which show important sample embodiments, wherein.

DETAILED DESCRIPTION OF THE PREFERRED EMBODIMENTS

Figure 1:
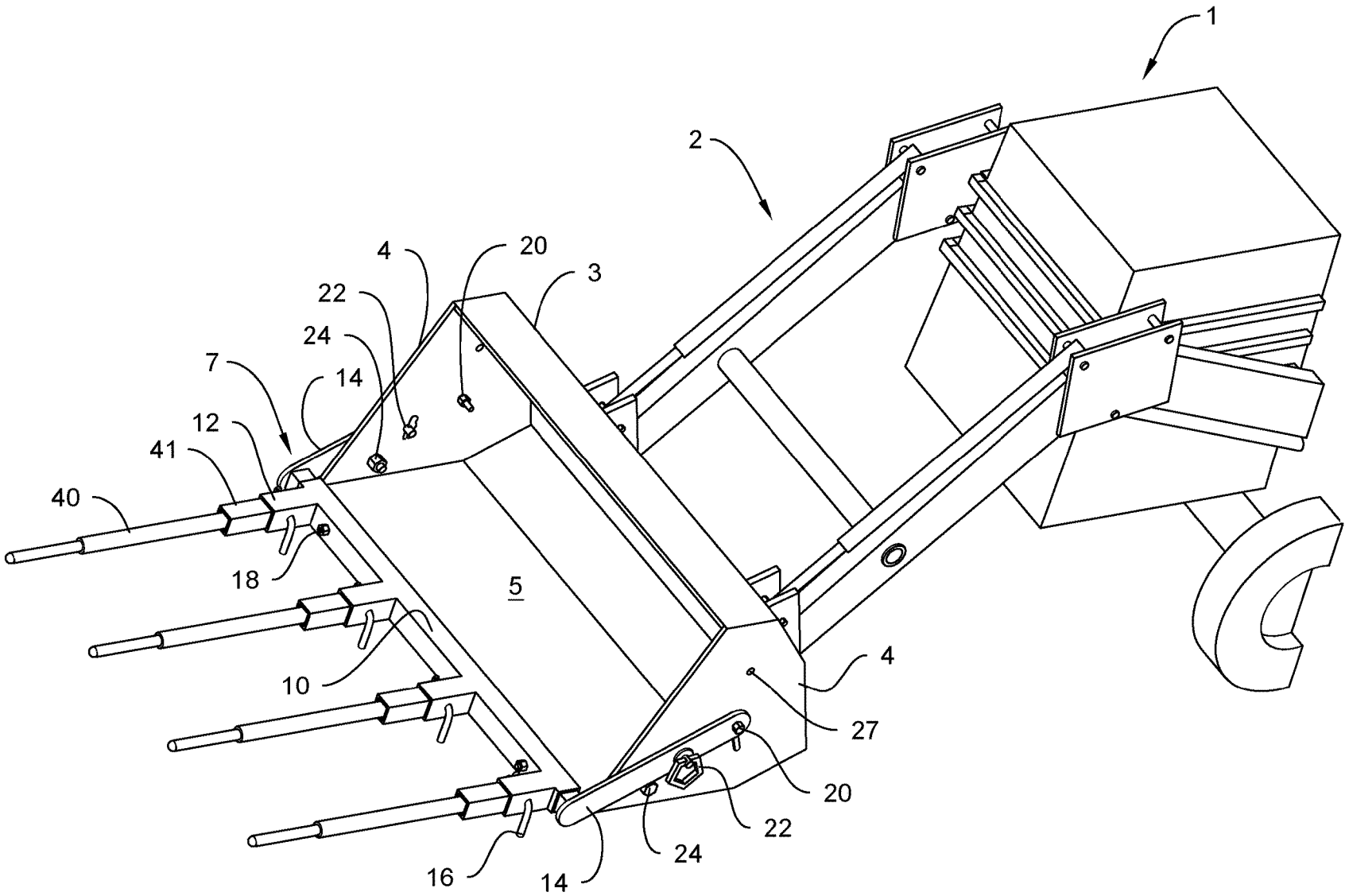
FIG. 1 is a front perspective view of the implement attachment device and implements mounted on a tractor bucket.

FIG. 1 illustrates an implement attachment device 7 configured to be mountable on a tractor bucket 3 where the tractor bucket is attached to one or more tractor arms 2 of a tractor 1. The implement attachment device 7 includes a main receiver bar 10 that is provided with one or more receivers 12 that serve as sockets into which the shank 41 of an implement 40 may be fitted. An implement pin 16 is used to reversibly attach the implement 40 to the main receiver bar 10 by reversibly pinning the shank 41 of the implement 40 within the body of the receiver 12. The main receiver bar 10 is rigidly affixed to a pair of swing arms 14. In one embodiment, rigid affixation of the swing arms 14 to the main receiver bar 10 is accomplished by means of at least one fastener 18 per swing arm 14 rigidly affixing the swing arms 14 to the main receiver bar 10. Each swing arm 14 is attached to a side wall 4 of the tractor bucket 3 by a pivot pin 20 and a positioning pin 22. The implement attachment device 7 is shown in a use-ready position in FIG. 1. in which the swing arms 14 are angled downward from the location of the pivot pin 20 toward the bottom wall 5 of the tractor bucket 3 such that the main receiver bar 10 is located toward the bottom of the bucket 3 and in close proximity to the front edge of the bottom wall 5 of the tractor bucket 3 with the one or more receivers 12 facing forward. As can be seen in referring to FIG. 1, when the implement attachment device 7 is in a use-ready position, the top position hole 27 through each sidewall 4 of the bucket 3 is not in use because the positioning pin 22 is engaged in the bottom position hole (not shown) in order to maintain the implement attachment device 7 in the use-ready position. In a preferred embodiment, the implement attachment device 7 will also feature a pair of support members 24, each of which is a protrusion that is rigidly affixed to, and extending from, a surface of each sidewall 4 of the tractor bucket 3. The support members 24 physically support the swing arms 14 when the implement attachment device 7 is in the use-ready position as shown in FIG. 1. The support members 24 are either a metal protrusion welded onto each sidewall 4 of the bucket 3, or preferably, a bolt or screw that is rigidly affixed to the sidewall 4, possibly using a nut or washer and nut where the bolt or screw is inserted through a support hole (not shown in FIG. 1) in the sidewall 4 and engages the nut on the opposing planar side of the sidewall 4. It is also possible to use a pin as a rigid support member 24 without departing from the scope of the inventive concepts hereby disclosed. While the inventive concepts disclosed may be practiced without the rigid support members 24, it is not advisable to do so since the support members 24 provide physical support for carrying heavier loads using the attached implements 40.

Figure 2:
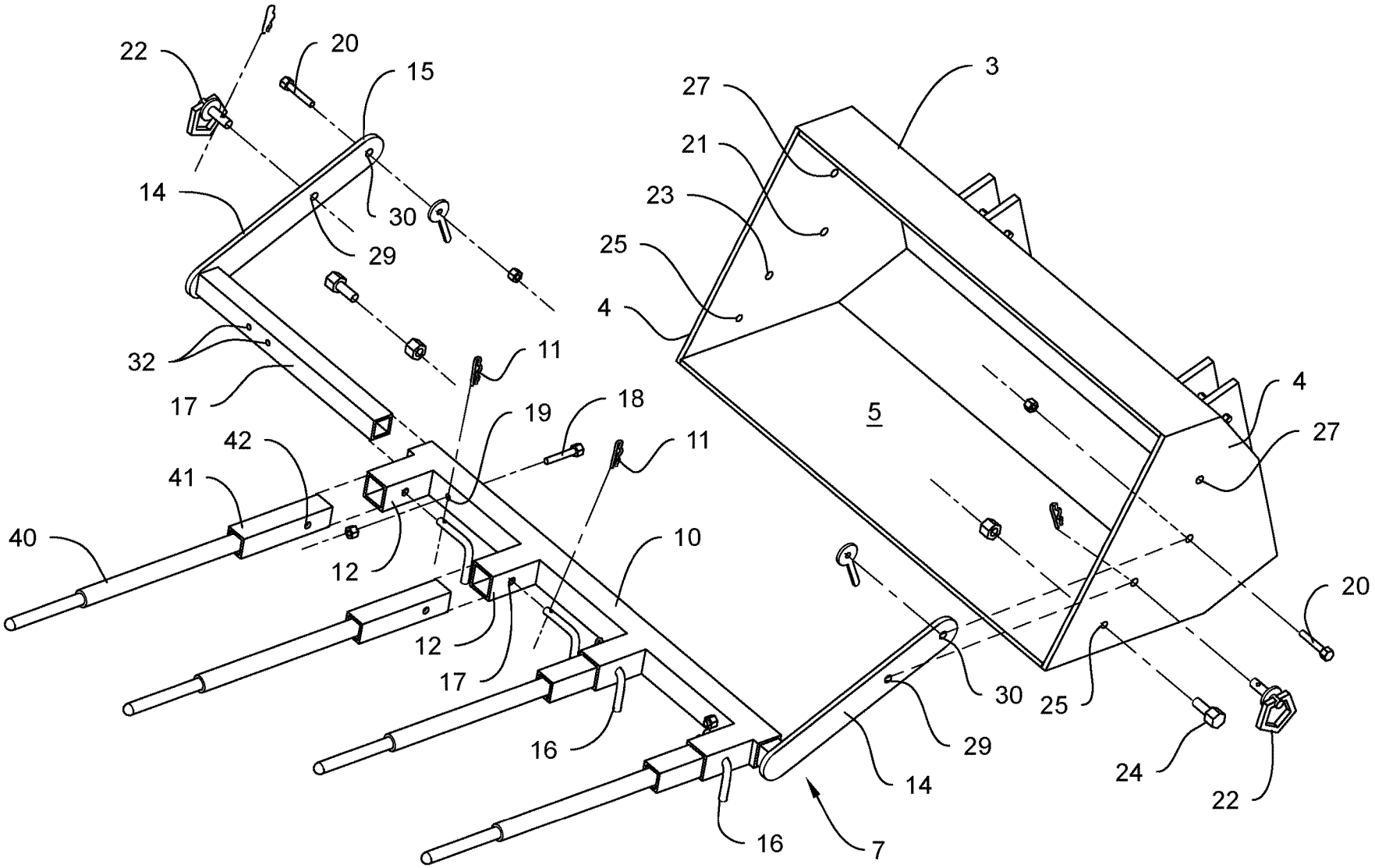
FIG. 2 is an exploded perspective view of the implement attachment device, attached implements, and a tractor bucket.

FIG. 2 is an exploded front perspective view of the implement attachment device 7 and the tractor bucket 3 that illustrates additional features of the implement attachment device 7. As can be seen in FIG. 2, the main receiver bar 10 includes at least one, and preferably a multiplicity of, receivers 12, wherein each receiver 12 has one or more receiver holes 17 that pass through one or more walls of the receiver 12. As shown by path lines in FIG. 2, an implement 40 may be inserted into a receiver 12 by inserting the shank 41 of the implement 40 into a receiver 12 and then inserting an implement pin 16 through the receiver holes 17 and through a pin hole 42 that is provided through the shank 41 of the implement 40. The implement pin 16 may be any suitable type of attachment means such as a screw, bolt, hitch pin, or other similar attachment means, but in a preferred embodiment the implement pin 16 is a bolt or a pin secured in place by a cotter pin 11 (such as a clevis pin—cotter pin combination or other similar arrangement) that fits around an end of the implement pin 16 or through a hole provided through the implement pin 16 (not shown) to secure it in place in a manner that is well understood by those skilled in the art.

As can be appreciated from viewing the path lines shown in FIG. 2, during assembly of the implement attachment device 7 onto the tractor bucket 3, the pair of swing arms 14 will connect the main receiver bar 10 to the tractor bucket 3. Each swing arm 14 has a top pivot end 15 and a bottom slide end 17 that are orthogonal to each other. The top pivot end 15 of each swing arm 14 is reversibly attached to a sidewall 4 of the tractor bucket 3 by means of a pivot pin 20 and a positioning pin 22. As illustrated by path lines in FIG. 2, when the implement attachment device 7 is assembled on the tractor bucket 3, the pivot pin 20 is inserted through an arm pivot hole 30 that is disposed within the top pivot end 15 of each swing arm 14, and also through a bucket pivot hole 21 that is disposed within each side wall 4 of the tractor bucket 3. As further illustrated by path lines shown in FIG. 2, the top pivot end 15 of each swing arm 14 is reversibly connected to the tractor bucket 3 with a positioning pin 22 that is reversibly inserted through an arm positioning hole 29 and into either a bottom position hole 23 or a top position hole 27, both of which position holes are disposed at different locations within each sidewall 4 of the tractor bucket 3.

After assembly, the implement attachment device 7 will be in a use-ready position when the positioning pin 22 is inserted through the arm positioning hole 29 and through the bottom position hole 23. This arrangement will place the main receiver bar 10 into close proximity with the leading edge of the bottom wall 5 of the tractor bucket 3 with the one or more receivers 12 facing forward in relation to the bucket 3, and in this use-ready position, any attached implement 40 held by the main receiver bar 10 will extend forward from the leading edge of the bottom wall 5 of the tractor bucket 3. The implement attachment device 7 can be moved to a stowed position by removing the positioning pin 22 from the bottom position hole 23, swinging the top pivot ends 15 of both swing arms 14 upwards such that the main body of the device, including both swing arms 14 and the main receiver bar 10 that is connected between then, is rotated upwards around the pivot pin 20, and then inserting the positioning pin 22 into the top position hole 27. These steps will move the implement attachment device 7 from a use-ready position to a stowed position in which the swing arms 14 and main receiver bar 10 are held in place near the top of the bucket 3 by the positioning pins 20. Once the implement attachment device 7, including each swing arm 14 and the main receiver bar 10, is in the stowed position near the top of the tractor bucket 3, the tractor bucket 3 can then be used to scoop up, handle, and move particulate material in standard manner without interference from the implement attachment device 7 or any implement 40 that may still be attached to the main receiver bar 10 of the device. The pivot pins 20 will stay in their position in which they are engaged through the arm pivot holes 30 of the swing arms 14 and through the bucket pivot holes 21 of each sidewall 4 during the entire time that the device is switched between a use-ready position and a stowed position.

Figure 3:
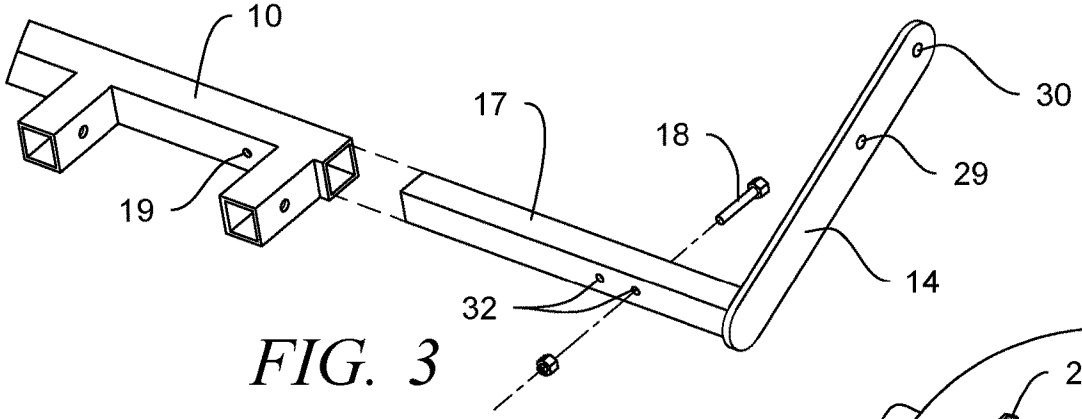
FIG. 3 is a closer perspective view of the swing arm and a portion of the main receiver bar of the implement attachment device demonstrating how the swing arm and the main receiver bar are slidably connected during assembly of the device.

As illustrated in FIG. 2 and FIG. 3, during assembly of the implement attachment device 7 onto the tractor bucket 3, the bottom slide ends 17 of the swing arms 14 are initially slidably connected to opposite ends of the main receiver bar 10 by inserting the bottom slide ends 17 in male-female fashion into openings that are disposed within each end of the main receiver bar 10 for receiving and slidably holding the bottom slide end 17 of a swing arm 14. Each bottom slide end 17 has a smaller cross-sectional area or smaller diameter than the openings at the ends of the main receiver bar 10 that serve as receiving means for the bottom slide ends 17, and therefore, during assembly but prior to final assembly, each bottom slide end 17 of each swing arm 14 is capable of sliding freely into and sliding to and fro within the body of the main receiver bar 10. During the assembly process, each bottom slide end 17 is adjusted by sliding it within the body of the main receiver bar 10 to a point where each swing arm 14 is in position adjacent to a sidewall 4 of the bucket 3 such that the top pivot end 15 of each swing arras 14 can be pinned to a sidewall 4 of the tractor bucket 3. The top pivot ends 15 of the swing arms 14 are then pinned to the bucket 3 using the pivot pins 20 that are inserted through the arm pivot holes 30 disposed within the pivot ends 15 and the bucket pivot holes 21 that are disposed within the sidewalls 4, and optionally also using the positioning pins 22 to pin the pivot ends 15 of the swing arms 14 to the sidewalls 4. Final assembly will involve the bottom slide ends 17 of each swing arm 14 being rigidly affixed to the main receiver bar 10. In some embodiments, rigid affixation of the bottom slide end 17 of each swing arm 14 to the main receiver bar 10 may be accomplished using one or more pre-marked holes 32 in the bottom slide ends 17 and one or more pre-set holes 19 in the main receiver bar 10, along with a bolt 18. Rigid affixation of each bottom slide end 17 of each swing arm 14 to the main receiver bar 10 may alternatively be accomplished using any other rigid affixation means, including but not limited to use of a screw with a nut or nut and washer, welding, pinning, or any other similar means that are well understood in the art. To the extent that pre-marked holes 32 may optionally be located on the bottom slide end 17 of each swing arm 14 in some embodiments, along with pre-set holes 19 that may optionally be located on the main receiver bar 10 at predetermined distances apart, the locations and distances of such pre-marked holes 32 and pre-set holes 19 will be such that the overall structure of the implement attachment device 7 may be adjusted to fit tractor buckets of several different commonly-encountered widths at the time of assembly. Use of pre-marked holes 32 and pre-set holes 19 is not required to practice the invention, but are part of an optional embodiment. In a preferred embodiment, the implement attachment device 7 will be able to be assembled onto any tractor bucket 3 having a width of between 48 inches to 72 inches, with the width of the bucket 3 being the distance measured between the outside planar surfaces of the opposing sidewalls 4 of the bucket 3. Thus, in such a preferred embodiment, the bottom slide ends 17 of the swing arms 14 are capable of being slidably adjusted during assembly by sliding them to and fro within the body of the main receiver bar 10 and then rigidly affixing each to the main receiver bar 10 during final assembly in a position such that the top pivot ends 15 of the pair of swing arms 14 will be anywhere from 48 inches to 72 inches apart when the implement attachment device 7 is finally assembled on a bucket, with the distance between the top pivot ends 15 of the swing arms 14 being determined by the width of the tractor bucket 3 onto which the device is being assembled.

Figure 4:
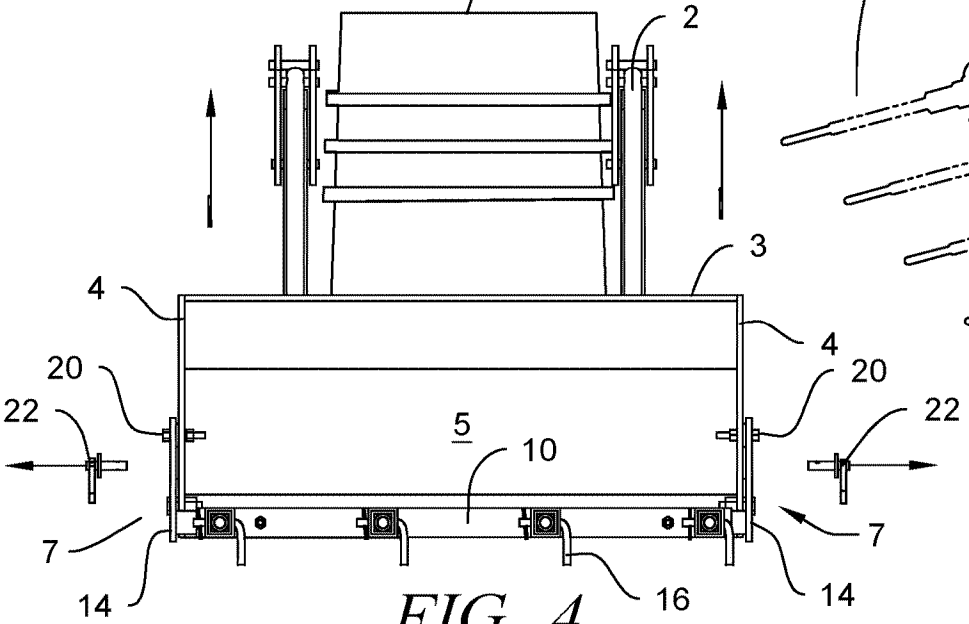
FIG. 4 is a front view of the implement attachment device mounted on the bucket of a tractor demonstrating how the positioning pins may be removed from the bottom position holes in the tractor bucket's sidewalls.

FIG. 4 is a front view of the implement attachment device 7 mounted on a tractor bucket 3, which is, in turn, mounted on tractor arms 2 of a tractor 1. Arrows in FIG. 4 demonstrate the removal of the positioning pins 22 from the bottom position holes (not shown in front view) that are disposed through the sidewalls 4 of the tractor bucket 3. Removal of the positioning pins 22 is required in order to switch the implement attachment device 7 from the use-ready position at the bottom of the tractor bucket 3 where the main receiver bar is located near the bottom wall 5 of the bucket 3 to a stowed position near the top of the tractor bucket 3 by rotating the main body of the device, including the swing arms 14 and the main receiver bar 10, upwards around the pivot pins 20 that will stay in place during this switch.

Figure 5:
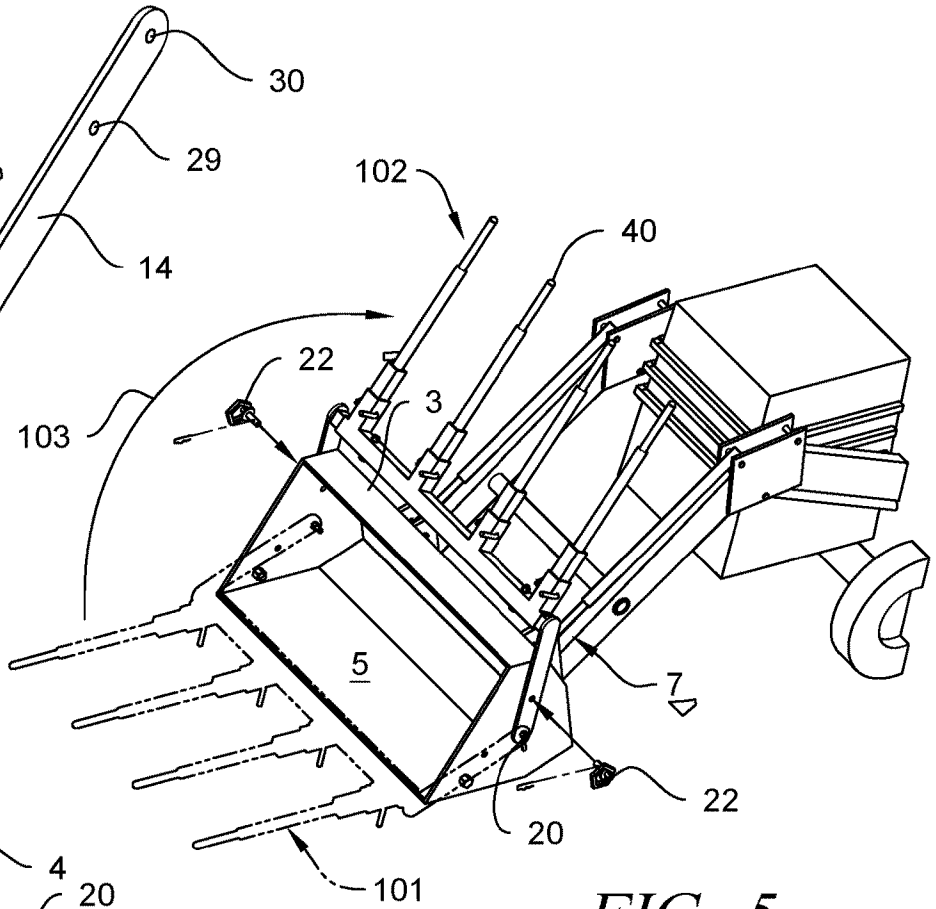
FIG. 5 is a front perspective view of the implement attachment device mounted on a tractor bucket demonstrating movement of the device from a use-ready position to a stowed position.

FIG. 5 is a front perspective view of the implement attachment device 7 mounted on a tractor bucket 3 where the switching of the implement attachment device 7 from the use-ready position 101 that is shown in phantom with a dashed line, to an upright stowed position 102, is illustrated. The curved arrow 103 illustrates rotation of the implement attachment device 7 and an attached implement 40 upward around the pivot pin 20 to the stowed position 102. Additional arrows demonstrate insertion of the positioning pins 22 into the top position holes (not labeled) in order to place the device into the stowed position 102 near the top of the bucket 3.

Figure 6:
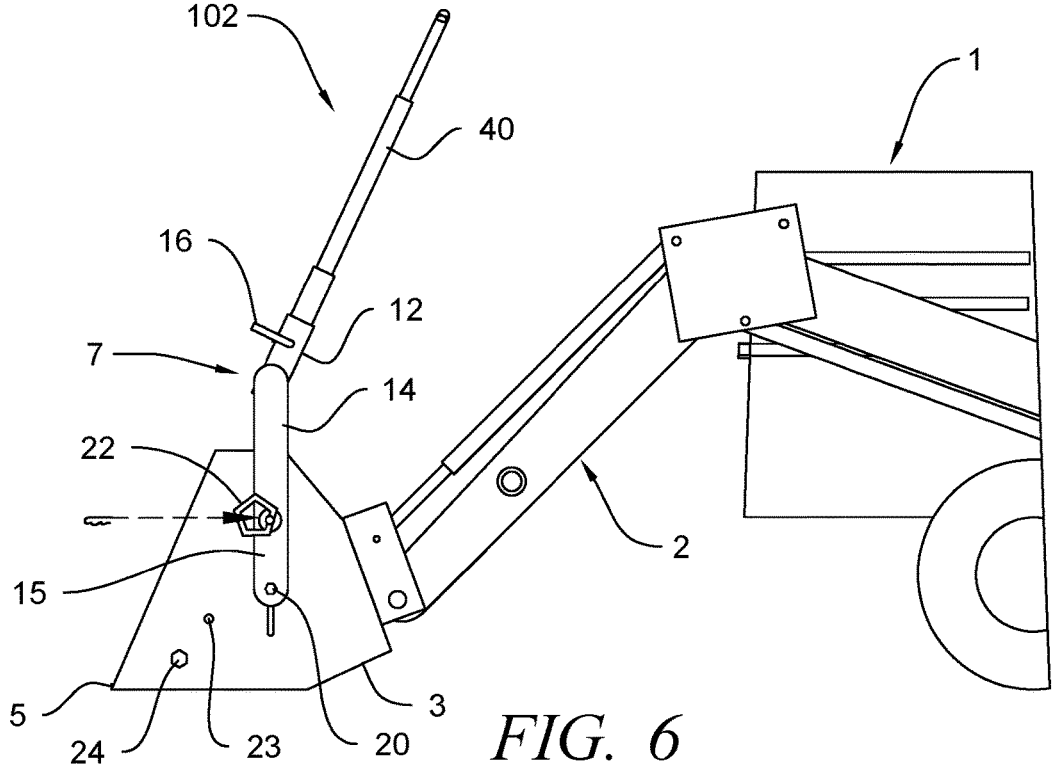
FIG. 6 is a side view of the implement attachment device mounted on a tractor bucket.

FIG. 6 is a side view of the implement attachment device 7 mounted on a tractor bucket 3 in the stowed position 102. As can be observed in reference to FIG. 6, when the device is in a stowed position 102, both swing arms 14, the main receiver bar (not visible in side view), and any implement 40 that may be attached to a receiver 12 by means of an implement pin 16, will be located near the top of the bucket 3 and away from the bottom wall 5 of the bucket 3. FIG. 6 illustrates that the positioning pins 22 are not engaged in the bottom position holes 23 that are disposed through each sidewall 4, but rather, they are engaged with the top position holes (not shown) closer to the top of the bucket 3 such that the implement attachment device 7 is no longer in front of the tractor bucket 3, but is in the stowed position 102 at the top of the bucket 3.

Figure 7:
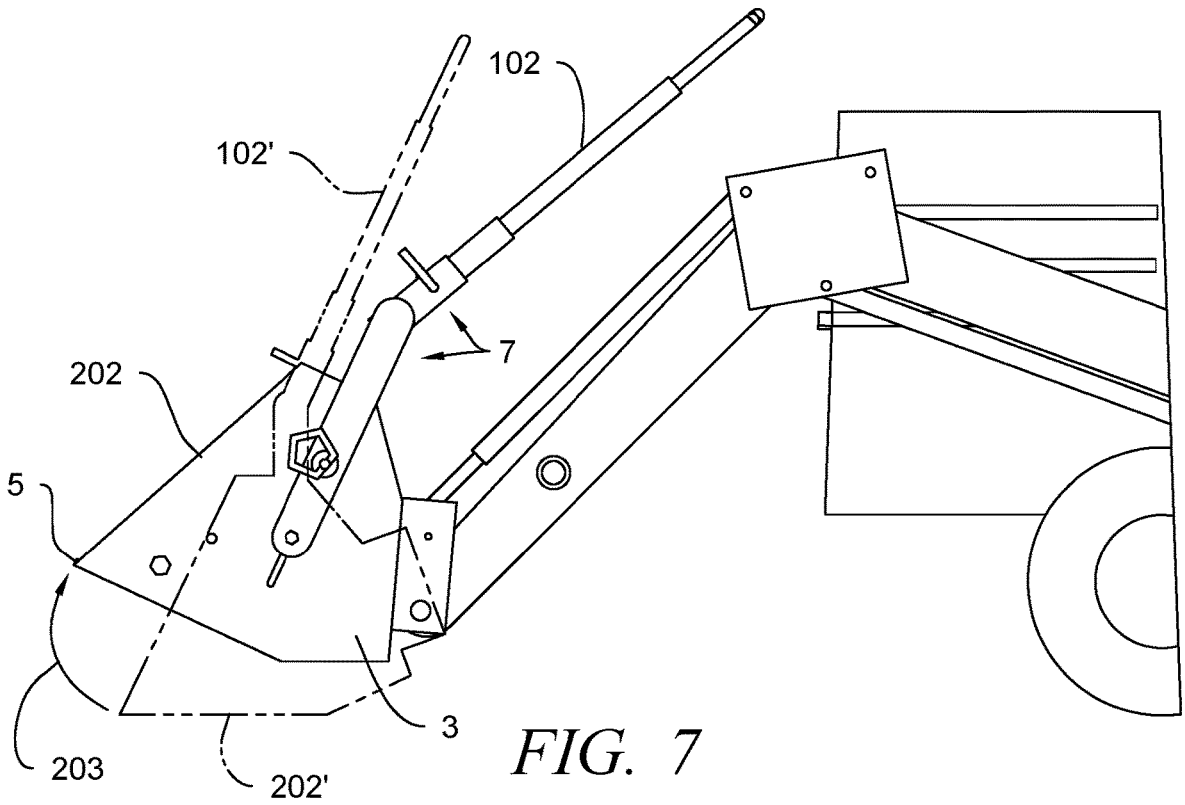
FIG. 7 is a side view of the implement attachment device mounted on a tractor bucket demonstrating scooping motion of the tractor bucket when the device is in a stowed position.

FIG. 7 is a side view of the implement attachment device 7 illustrating use of the tractor bucket 3 to scoop materials up when the implement attachment device 7 is pinned in a stowed position 102 near the top of the bucket 3. The tractor bucket 3 is illustrated as moving with scooping action from a first bucket location 202' that is shown in phantom with dashed lines, to a second bucket location 202, while the implement attachment device 7 remains in the stowed position 102 (the device in the stowed position prior to movement of the bucket is shown in phantom at location 102' with dashed lines). As can be visualized and understood from reviewing FIG. 7, when the implement attachment device 7 is pinned in a stowed position 102, the implement attachment device 7 will be located away from the bottom wall 5 of the bucket 3 and therefore the bucket 3 can be used in standard fashion to scoop up particulate materials and move them from one place to another.

Figure 8:
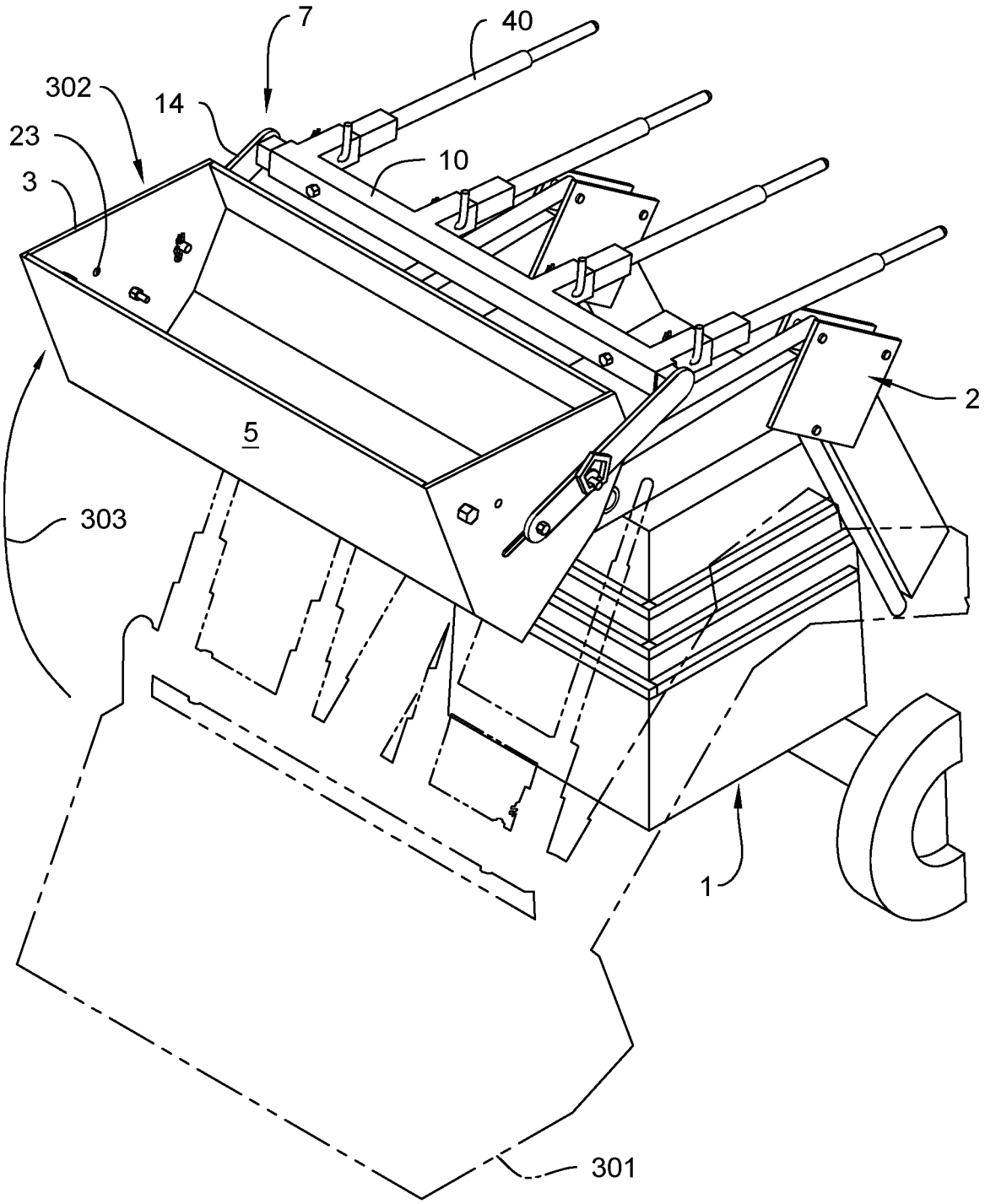
FIG. 8 is a front perspective view demonstrating movement of the tractor bucket when the device is in a stowed position.

FIG. 8 is a front perspective view of the implement attachment device 7 assembled on a tractor bucket 3 where the tractor bucket 3 is illustrated as being raised upward by a curved arrow 303 in order to move or haul particulate materials in the bucket 3 in standard fashion. As can be seen, when the tractor bucket 3 is raised from an initial lower position 301 illustrated in phantom by dashed lines, to a subsequent higher position 302, the implement attachment device 7, including the main receiver bar 10 and the swing anus 14, along with any attached implement 40, moves with the bucket 3 as it is raised to the higher position 302. Thus, the implement attachment device 7 can remain in the stowed position without interfering with an operator raising or lowering the tractor bucket 3, and without interfering with moving or hauling of particulate materials from one place to another using the tractor 1 and its bucket 3.

Figure 9:
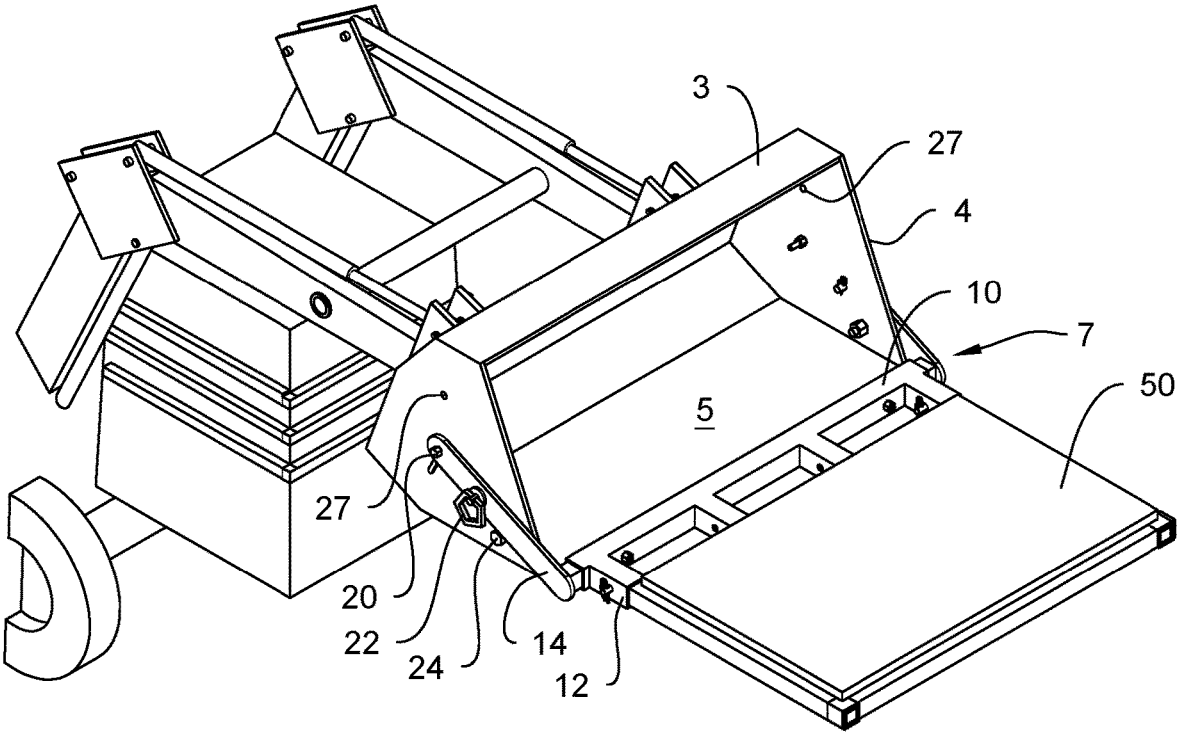
FIG. 9 is a front perspective view of the implement attachment device mounted on a tractor bucket with the device in a use-ready position and with a platform type of implement connected to the tractor bucket using the device.

FIG. 9 is a front perspective view of the implement attachment device 7 as assembled on a tractor bucket 3 with the implement attachment device 7 in a use-ready position in which the positioning pins 22 have been removed from the top position holes 27 that are disposed within the sidewalls 4 of the tractor bucket 3 and have been re-pinned in the bottom position holes (not labeled) that are located closer to the bottom wall 5 of the tractor bucket 3. The embodiment of the implement attachment device 7 is shown with the optional support members 24 in place on the sidewalls 4 to provide physical support for the swing arms 14 of the device. FIG. 9 illustrates the fact that a platform type implement 50 may be attached to the bucket 3 using the implement attachment device 7 by inserting the shanks (not shown) of the platform type implement 50 into the receivers 12 of the main receiver bar and reversibly pinning them in place by inserting implement pins (not labeled) through one or more receiver holes (not labeled) disposed within the receivers 12 and through pin holes disposed (not visualized) within the shanks of the platform type implement 50 in a similar fashion to what was previously illustrated for the implement 40 that is shown in FIG. 2.

Figure 10:
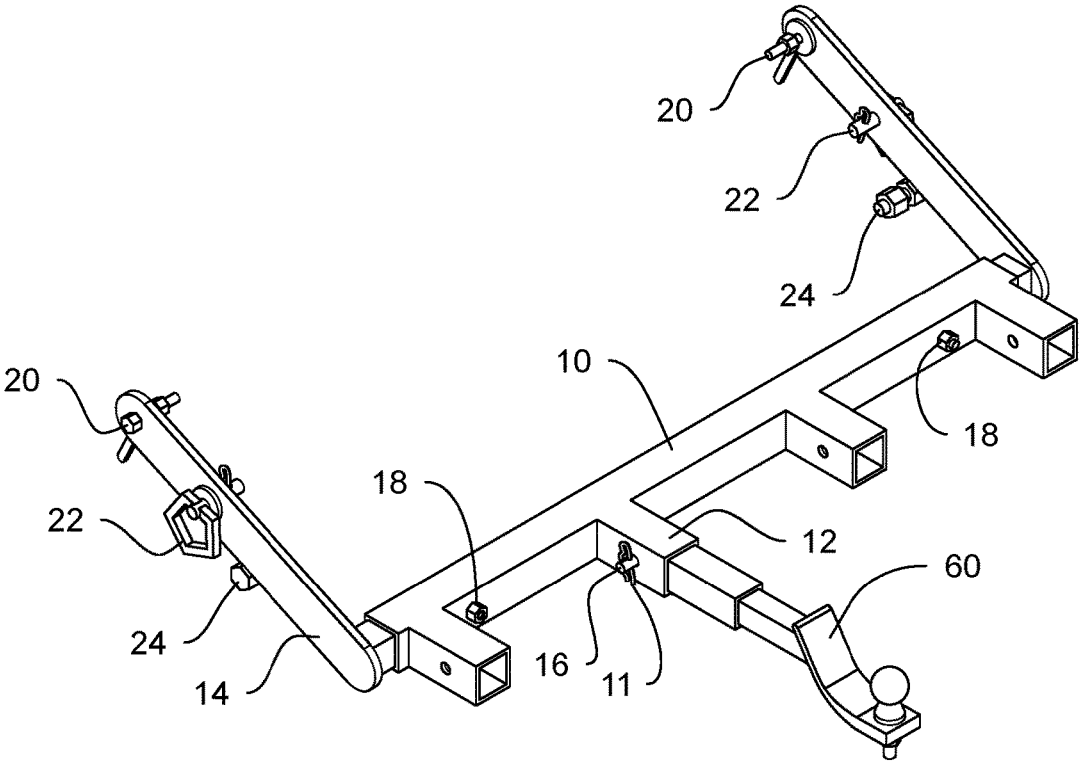
FIG. 10 is a front perspective view of the implement attachment device with a ball hitch implement attached to the tractor bucket using the device.

FIG. 10 demonstrates that a ball hitch type implement 60 may be inserted into a receiver 12 of the main receiver bar 10 and pinned in place using an implement pin 16. The ball hitch type implement 60 allows the operator of a tractor to move ball hitch trailers (not shown) from one place to another using a tractor on which the device has been assembled.

Figure 11:
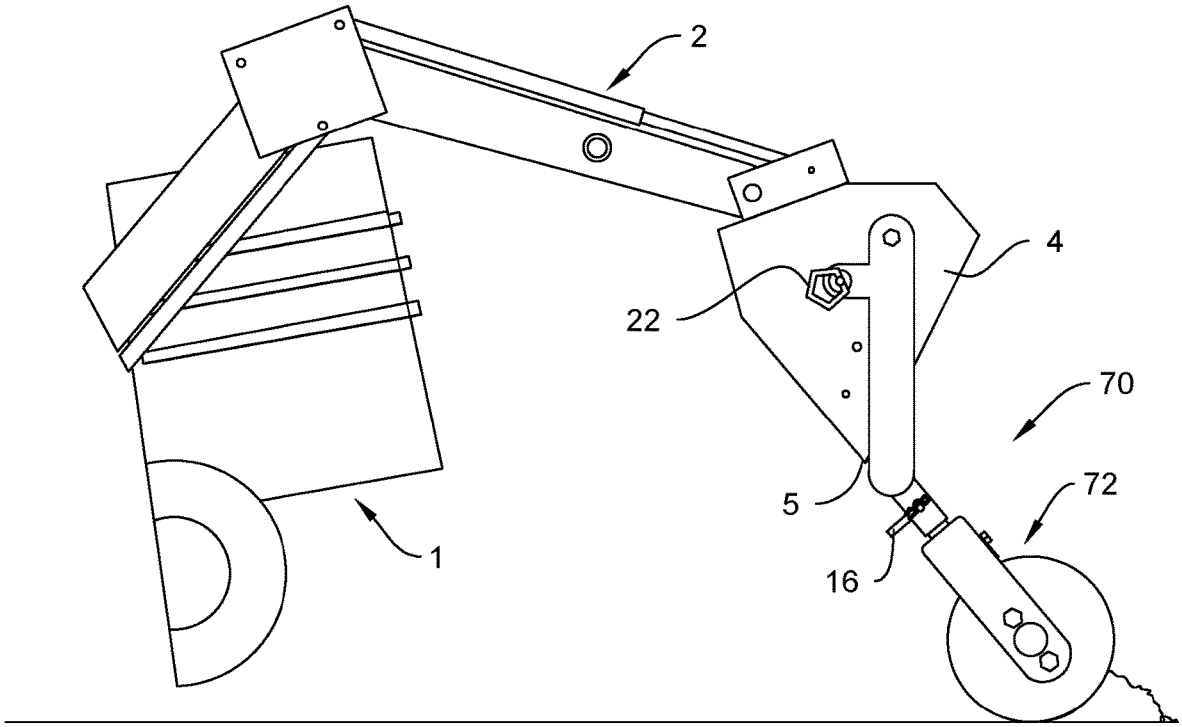
FIG. 11 is a side view of the tractor implement device mounted on the tractor bucket of a tractor with a roller implement connected to the bucket using the device and wherein the roller implement is being used to smooth a surface.
Figure 12:
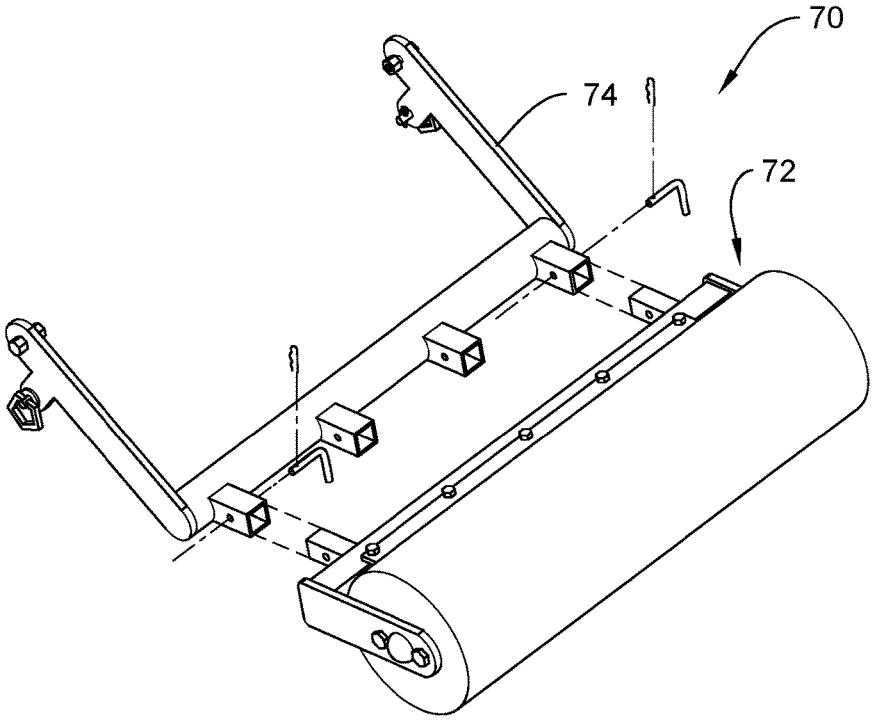
FIG. 12 is a front perspective view of the implement attachment device and a roller implement showing how the roller implement may be mounted onto the main receiver bar of the device in order to connect the roller implement to a tractor bucket.

FIG. 11 and FIG. 12 both illustrate that a roller implement 72 may be attached using the device by the interconnection method 70 demonstrated in which implement pins 16 are used to connect the roller implement 72. FIG. 12 also specifically illustrates an alternative embodiment of the implement attachment device 74 in which the entire implement attachment device is all one unitary piece of metal or plastic and there is no assembly of individual swing arms and main receiver bar to form an assembly because the entire implement attachment bar is a single, unitary piece of equipment that comprises a metal or plastic frame with main receiver bar and swing arms that are all part of the unitary structure that can be attached to the sidewalls of a tractor bucket and used to attach various types of implements such as the roller implement 72 that is illustrated.

The primary purpose of FIG. 10-FIG. 12 is to demonstrate that a multiplicity of different types of tools and implements may be attached to a tractor bucket using the implement attachment device and that the types of tools or implements that may be attached using the device are not limited to fork or tine type tools. In practice, several other implements that are not illustrated by the drawings, such as a grape vine puller and an elongated hay spike, have also been demonstrated as implements that may be attached to a tractor bucket using the implement attachment device, wherein each implement has one or more shanks with pin holes such that the shanks of the implements may be inserted into one or more receivers of the main receiver bar and pinned in place with implement pins in a manner similar to what has been shown and illustrated in the attached patent drawings.

For purposes of the drawings and the description provided hereinabove, the connections between the swing arms 14 and the sidewalls 4 of the bucket 3 may be pins, bolts, screws, or any other similar fastener that may be used to reversibly connect the swing arms 14 to the sidewalls 4 utilizing the various types of holes in the swing arms 14 and sidewalls as have been described. The terms "pin," "bolt," or screw," are not meant to be limiting, and it should be understood that any type of reversible fastener that allows for rotational pivoting motion of the top pivot end 15 of the swing arms 14 in order to move the implement attachment device 7 between the use-ready position 101 and the stowed position 102 comes within the scope of the inventive concepts defined within the appended hereto. Likewise, any type of reversible fastener that allows for reversibly locking the implement attachment device 7 in place in either the stowed position 102 or the use-ready position 101 comes within the scope of the inventive concepts.

In a preferred embodiment of the inventive concepts disclosed, all of the connections between the pivot ends 15 of the swing arms 14 and the sidewalls 4 of the bucket 3 are pins that may be relatively quickly pinned or unpinned in place as described in the foregoing descriptions. The reason for the use of pins in the preferred embodiment instead of bolts or screws with a nut or locking nut, is that pins can be readily removed in order to disconnect the entire implement attachment device from the bucket of a tractor and then simply move the tractor and its bucket backward away from the device. While other previous implement adapter devices have been touted as providing a "quick-release" feature or other similar ease of connection and disconnection, the implement attachment device that is hereby disclosed actually fulfills such promises because removal of two pins on each side of the tractor bucket is all that is required to disconnect the device from the tractor.

To the extent that pins are used in some embodiments of the device, including the preferred embodiment, the pins that are employed may be a clevis pin—cotter pin type combination, bow-tie locking cotter pin combination, hitch pin, or any other similar type of pin or pin combination that provides for easy connection and easy disconnection of the swing anus and the sidewalls of the bucket. The connections may also be accomplished using bolts, screws, washers, or other similar reversible connection means, but quickly removable pins are the preferred types of connectors for the device for the reasons stated above.

It should also be recognized that the support members 24 shown in the drawings and discussed in the description above, though optional, are an important aspect of the preferred embodiment of the inventive concepts hereby disclosed. While such support members 24 connected to the sidewalls are not strictly required to practice the inventive concepts disclosed, to the extent that extremely heavy loads are to be loaded onto one or more implements attached to the tractor bucket 2 using the implement attachment device 7, the support members 24 will provide a significant amount of physical support to the swing arms 14 supporting the heavy load. The support members 24 may be welded metal protrusions, bolts, screws, washers, or any other type of solid protrusion from the sidewalls 4 that serves as a support for the swing arms 14. Alternatively, the inventive concepts disclosed may be practiced with alternative types of support for the device, such as support means rigidly affixed to the bottom wall 5 of the bucket 3 that would underlie and support the main receiver bar 10 when it is in a use-ready position. Although such alternative means of support come within the scope of the inventive disclosure described and hereinafter claimed, the inventor's preferred embodiment involves support members that are rigid protrusions from the sidewalls of the bucket.

With regard to the pre-marked holes 32 provided along the bottom slide end 17 of each swing arm 14 and the pre-set holes 19 provided in the main receiver bar 10 in some embodiments, it should be appreciated that such pre-marked holes 32 and such pre-set holes 19 are not strictly necessary to practice the inventive concepts disclosed. Furthermore, to the extent that such pre-marked holes 32 and such pre-set holes 19 are used in a preferred embodiment of the implement attachment device 7, there will be two pre-set holes 19, with each of pre-set holes 19 being a true hole through the main receiver bar 10 that is located in relative proximity to the ends of the main receiver bar 10 and at some distance from the center of the main receiver bar 10. With reference to the pre-marked holes 32, such pre-marked holes 32 will not be true holes through the bottom slide ends 17 of the swing arms 14, but rather, the pre-marked holes 32 will be a multiplicity of dimples or etched spots within each of the bottom slide ends 17 where a true hole through each of the bottom slide ends 17 can be drilled during assembly of the device in order to subsequently rigidly affix the bottom slide ends 17 of the swing arms 14 to the main receiver bar 10 by means of bolts, screws, or pins in the manner described above. The reason for using dimples or etched spots for the pre-marked holes 32 along the bottom slide ends 17 rather than actual pre-drilled holes is that the inventor has discovered during a reduction to practice that a multiplicity of pre-drilled holes that are actual holes through bottom slide ends 17 of the swing arms 14 reduces the overall integrity and physical strength of the entire implement attachment device 7 once it is assembled and put into use. As a result, in a preferred embodiment incorporating the pre-marked holes 32 that are set at certain distances along the bottom slide ends 17, the assembler of the device will position the bottom slide ends 17 of the swing arms 14 within the ends of the main receiver bar 10 and slide the swing arms 14 to the proper width apart in relation to the width of the tractor bucket 3, and then the assembler will drill an actual hole through one of the pre-marked holes 32 in each of the bottom slide ends 17 and use a bolt, screw, or pin to rigidly affix each of the swing arms 14 to the main receiver bar 10 using each of the now-drilled pre-marked holes 32 in a manner that is well understood in the art.

Although the inventive concepts hereby disclosed have been described with reference to specific embodiments, it should be understood that the above-described specific embodiments are not intended to limit the scope of the inventive concepts disclosed, but merely to illustrate some of the specific embodiments of the implement attachment device. It should be understood that various modifications of the disclosed embodiments, as well as alternative embodiments of the inventive concepts, will be apparent to persons skilled in the art upon reference to the description of the embodiments that is provided or upon reference to the appended claims. It is, therefore, contemplated that the appended claims will cover and read upon all such modifications and alternative embodiments that fall within the scope of the inventive concepts that are claimed by the inventor.

I claim:

1. An assembly for attaching implements to a tractor bucket comprising:

a main receiver bar positioned outside the tractor bucket;

implement connection means provided by said main receiver bar where at least one implement may be reversibly connected to the main receiver bar at any given time, and wherein the said implement connection means of the main receiver bar allow for different types of implements having different functionality to be selectively attached to and detached from the tractor bucket by the user; and a pair of swing arms positioned outside the tractor bucket wherein each swing arm is connected to a side wall of the tractor bucket and wherein each swing arm is also connected to the main receiver bar such that the main body of the assembly is comprised of the main receiver bar, the implement connection means, and the swing arms;

wherein each swing arm is connected to a side wall of the tractor bucket by pivot connection means that allow for the pair of swing arms to be rotated upward toward the top of the tractor bucket or downward toward the bottom wall of the tractor bucket, thereby raising or lowering the main body of the assembly in relation to the tractor bucket;

and wherein each of the swing arms is comprised of a pivot and a slide end where the pivot end is orthogonal to the slide end, and wherein each pivot end is pivotably connected to a side wall of the tractor bucket by the pivot connection means and each slide end is slidably connected to an end of the main receiver bar such that the main body of the assembly may be connected to tractor buckets of varying widths, and wherein the swing arms are further reversibly connected to a side wall of the tractor bucket by removably positioning means.

2. An assembly as in claim 1 wherein the pivot connection means are comprised of:

an arm pivot hole that is disposed within each swing arm;

a bucket pivot hole that is disposed within each side wall of the tractor bucket; and a pair of pivot pins wherein each pivot pin is reversibly inserted through the arm pivot hole and reversibly inserted through the bucket pivot hole on each side of the assembly such that the pair of pivot pins allow for the swing arms and the main receiver bar to be rotated upward or downward in relation to the tractor bucket.

3. An assembly as in claim 2 wherein the removable positioning means are comprised of:

an arm positioning hole disposed within each swing arm;

two position holes that are disposed within each side wall of the tractor bucket;

a pair of removable positioning pins wherein each removable positioning pin is reversibly inserted through the arm positioning hole of each swing arm and is further reversibly inserted into one or the other of the two position holes in a sidewall of the bucket such that the pair of swing arms and the main receiver bar may be reversibly locked into position in at least one of two predetermined positions in relation to the tractor bucket where the predetermined positions are determined by the locations of the position holes.

4. An assembly as in claim 3 wherein at least one support member is rigidly affixed to the tractor bucket and protrudes outside of the tractor bucket such that the at least one support member will provide physical support to the assembly when the swing arms and main receiver bar are placed into position in at least one of the two predetermined positions.

5. An assembly as in claim 4 wherein the implement connection means provided by the main receiver bar is comprised of a socket provided in the main receiver bar into which the shank of an implement may be reversibly inserted and reversibly pinned in place using a removable implement pin.

6. An assembly as in claim 5 wherein said main receiver bar includes a multiplicity of implement attachment means by which the shanks of a single implement or the shanks of multiple implements may be reversibly held in place with removable implement pins.

7. An assembly as in claim 6 wherein the multiple implement attachment means of the main receiver bar are used to selectively connect multiple implements having different structure and functionality to the main receiver bar.

8. A system for removably attaching a wide variety of implements to the buckets of tractors comprised of:

The assembly of claim 1 wherein the implement connection means of the main receiver bar allows for contemporaneous attachment of multiple implements; and A multiplicity of tines with shanks that may be removably pinned in place to the main receiver bar so as to form a fork-type tool.

9. The system of claim 8 further comprising a platform type implement that may be removably pinned in place to the main receiver bar.

10. The system of claim 8 further comprising a hay fork type implement that may be removably pinned in place to the main receiver bar.

11. The system of claim 8 further comprising a ball and hitch type implement that may be removably pinned in place to the main receiver bar.

12. The system of claim 8 further comprising a roller type implement that may be removably pinned in place to the main receiver bar.

13. The system of claim 8 further comprising a grape vine puller implement that may be removably pinned in place to the main receiver bar.

14. The system of claim 8 further comprising:

A platform type implement;

A hay fork type implement;

A ball and hitch type implement;

A roller type implement;

A grape vine puller type implement.

15. A method of connecting implements to a tractor bucket comprising:

drilling four holes in each side wall of a tractor bucket;

slidably connecting a pair of swing arms to a main receiver bar such that one swing arm is connected to each end of the main receiver bar;

adjusting the spacing of the swing arms so that they each of the swing arms is aligned parallel to the side walls of a tractor bucket and the swing arms and main receiver bar cooperate to serve as a u-shaped frame around the bucket;

pivotably attaching each swing arm to the side wall of a tractor bucket with a pivot pin that is inserted through a first hole in each swing arm and into a corresponding pivot hole in the side wall of the tractor bucket such that the pair of swing arms may be rotated upward or downward in relation to the tractor bucket by virtue of pivoting there around the pivot pins that are inserted through the first hole and the pivot hole on each side of the frame;

rigidly affixing each swing arm to an end of the main receiver bar;

inserting a support member into the lowest hole in each of the tractor bucket side walls in a manner such that the support member protrudes outside of the tractor bucket in order to provide stopping means and physical support for the swing arms when they are lowered to their lowest possible position, reversibly connecting each swing arm to a side wall of the tractor bucket with position pins that pass through a second hole in each swing arm and are reversibly inserted into one or the other of the two remaining holes in the side wall of the tractor bucket such that when the positioning pins are inserted into the lower of the two remaining holes in the side walls, the frame will be in its lower, use-ready position, and when the positioning pins are inserted into the upper of the two remaining holes in the side walls, the frame will be in its upper, stowed position;

reversibly connecting at least one, and possibly multiple, implements to the main receiver bar by means of reversibly pinning the one or more implements to the main receiver bar;

wherein the swing arms and main receiver bar that form the assembly's u-shaped frame are at all times positioned outside of the tractor bucket, and wherein the u-shaped frame may be swung upwards by means of the pivot pins and locked into a stowed position that is above the tractor bucket by means of the position pins; and wherein the implements that may be reversibly connected to the main receiver bar may have different structure and functionality such that a user may selectively attach or detach implements of different types when using the assembly in connection with a tractor bucket.

* * * * *